US005097295A

United States Patent [19]

Tanaka

[11] Patent Number: 5,097,295

[45] Date of Patent: Mar. 17, 1992

[54] DEVELOPING APPARATUS WITH IMPROVED DEVELOPER RETURN MECHANISM

[75] Inventor: Yoshihiko Tanaka, Moriguchi, Japan

[73] Assignee: Mita Industrial Co., Ltd., Osaka, Japan

[21] Appl. No.: 682,892

[22] Filed: Apr. 8, 1991

Related U.S. Application Data

[63] Continuation of Ser. No. 540,626, Jun. 19, 1990, abandoned.

[30] Foreign Application Priority Data

Jun. 30, 1989 [JP] Japan ..... 1-170973

[51] Int. Cl.[5] ..... G03G 21/00

[52] U.S. Cl. ..... 355/246; 118/689; 355/253

[58] Field of Search ..... 355/245, 246, 253, 259; 118/689, 690, 691, 693, 694

[56] References Cited

U.S. PATENT DOCUMENTS 4,044,719 8/1977 Ohmori ..... 355/253

4,226,524 10/1980 Hashimoto ..... 355/253

4,466,730 8/1984 Jugle ..... 355/253

FOREIGN PATENT DOCUMENTS 0015576 1/1987 Japan ..... 355/253

*Primary Examiner*—A. T. Grimley

*Assistant Examiner*—Christopher Horgan

*Attorney, Agent, or Firm*—Wenderoth, Lind & Ponack

[57] ABSTRACT

In order to prevent excessive developer, after regulating the height of the developer on a developing sleeve, from being accumulated on a partition plate even during the time when a developing apparatus is in a non-driven condition, the partition plate is provided, in a surface thereof facing a toner-concentration sensor, with holes for causing the developer to fall downwardly therethrough. Alternatively, an AC voltage is applied to the partition plate, or the partition plate is adapted to be swung or vibrated, or the partition plate is adapted to be movable so that the position of the partition plate during the time when the developing apparatus is in the non-driven condition is different from the during the time when the developing apparatus is being driven.

14 Claims, 11 Drawing Sheets

DEVELOPING APPARATUS WITH IMPROVED DEVELOPER RETURN MECHANISM

This application is a continuation of now abandoned application Ser. No. 07/540,626 filed June 19, 1990.

BACKGROUND OF THE INVENTION

1. Field of the Invention

The present invention relates to a developing apparatus employed in an image forming device of an electrophotographic copying machine or the like.

2. Description of the Prior Art

In a developing apparatus of this type, a developer includes toner particles and carrier particles and is housed in a casing. The thickness or height of the developer supplied onto a developing sleeve from a developer-stirring and supplying device is regulated by means of a height-regulating member. In order to return an excessive portion of developer removed from the sleeve by height-regulating member to the developer-stirring and supplying device, there is provided a partition plate constructed so that an upstream portion thereof in the direction of returning movement of the developer is horizontal and a downstream portion thereof connected with the upstream portion is inclined diagonally downwardly, e.g. as disclosed in U.S. Pat. No. 4,666,283.

However, in a developing apparatus of this type, the toner concentration of the developer to be returned is detected by means of a toner-concentration sensor, and upon detection that such concentration has become less than an appointed set value, new toner particles are supplied. Accordingly, it is necessary that the detection of the toner concentration of the developer returned over such partition plate be of high accuracy. Thus, a detecting surface of the toner-concentration sensor is provided on an upper wall surface of the case so as to be parallel to the horizontal upstream portion of the partition plate. However, the above described conventional developing apparatus has the disadvantage that it thereby is necessary that the height of the case be increased, and thus the developing apparatus becomes large-sized.

In order to solve such problem, a construction as shown in, for example, FIG. 15 was considered. That is to say, referring to FIG. 15, reference numeral 51 designates a photoreceptor rotating in the direction of an arrow R with an axis of rotation 51*a* as a center. Reference numeral 52 designates a case for housing therein a developer comprising toner particles and carrier particles. Case 52 is provided with an open portion 53 facing photoreceptor 51 and a developing member such as a sleeve 54 rotates in the direction of an arrow L with an axis of rotation 54*a* as a center to transport the developer to the photoreceptor 51. Developer-stirring and supplying means 55 rotates in the direction of an arrow L with an axis of rotation 55*a* as a center to stir the developer and simultaneously supply developing sleeve 54 with the developer. Developer-transporting means 56 rotates in the direction of arrow R with an axis of rotation 56*a* as a center to mixedly stir toner particles supplied from a toner-supplying portion (not shown) and excess or excessive developer returned along a partition plate 58 (to be discussed below) after regulation of the height of the developer supplied to sleeve 54, thereby supplying developer-stirring and supplying means 55 with the resulting mixture so as to be parallel to axis of rotation 51*a* of the photoreceptor 51.

Also, the case 52 is provided with a height-regulating member 57 for regulating the thickness or height of the developer on developing sleeve 54, formed in an upper portion within case 52. Partition plate 58 for returning excessive developer after regulating the height of the developer to developer-transporting means 56 is positioned above developer-stirring and supplying means 55. In this case, the partition plate 58 is formed in a chevron shape so as to not accumulate developer thereon. In addition, the case is provided with a toner-concentration sensor 59 in the vicinity of height-regulating member 57 so that a sensor 59*a* of toner-concentration sensor 59 faces an inclined surface 58*a* on an upstream side of the partition plate 58, with respect to the direction of returning movement of excess developer.

In a developing apparatus having the above described construction, the developing sleeve 54 is operated (e.g. rotated) to transport developer in the appointed direction during the time when copying is carried out to drive the developing apparatus. Thus, excessive developer after regulating the height of the developer is subjected to a centrifugal force resulting from such rotation to pass over the partition plate 58 and to be guided by the partition plate 58, as shown by arrows A in FIG. 16, and to be subjected to stirring in the appointed manner, and then the excessive developer is directed toward the developing sleeve 54, as shown by arrows B. Therefore, hardly any developer will be accumulated on the inclined upstream surface 58*a* of the partition plate 58 and or an inclined downstream surface 58*b* thereof.

However, upon completing a copying operation such that the developing apparatus will be in a non-driven condition, the operation of the developing sleeve 54 is stopped, so that excessive developer will be accumulated on both inclined surfaces 58*a*, 58*b*, as shown by reference numerals 60, 61. In particular, the accumulation of the developer on the inclined upstream surface 58*a* leads to the following disadvantages. That is to say, in a copying machine or the like wherein the developer comprises toner particles, which are insulating materials, and carrier particles, which are magnetic materials, and merely the toner particles are consumed, the toner concentration in the developer is reduced with the consumption of the toner particles. If this toner concentration reaches an appointed level or less, satisfactory developing cannot be achieved and thus a normal image cannot be obtained.

Thus, in a developing apparatus using the above described developer, in order to detect the toner concentration in the excessive developer, the toner-concentration sensor 59 is provided so as to face the inclined surface 58*a* on the upstream side, with respect to the developer returning direction, of the partition plate 58, thereby detecting such toner concentration. Accordingly, the toner concentration is prevented from reducing to less than the permissible value. Usually a coil is used as toner-concentration sensor 59 so that a change in magnetic permeability of the developer will be detected by a change in inductance of the coil.

However, if temperature and humidity within the case 52 become increased, the excessive developer accumulated on the inclined surface 58*a* will set due to such circumstances. Thus, the fluidity of the developer on inclined surface 58*a* is reduced, and it becomes difficult to detect a change in magnetic permeability of the developer by means of the toner-concentration sensor 59. As a result, it becomes difficult to exactly detect the toner concentration, and normal image formation is hindered.

SUMMARY OF THE INVENTION

The present invention has been developed in view of the above described matters, and it is an object of the present invention to provide a developing apparatus capable of preventing excessive developer that is removed from the screen after regulating the height of the developer from being accumulated on an upper surface of a partition plate so that it is always possible to exactly detect the toner concentration of such returned developer, even when the developing apparatus is in a non-driven condition.

In order to achieve the above described object, according to the present invention a developing apparatus includes a developing member such as a sleeve for transporting a developer comprising toner particles and carrier particles to a photoreceptor, a height-regulating member for regulating the thickness or height of the developer supplied to the developing sleeve, a partition plate for returning excessive developer after regulating the height of the developer by means of the height-regulating member, and a toner-concentration sensor for detecting the concentration of toner in the excessive developer passing over the partition plate.

In a first embodiment of the invention, the partition plate is provided with holes formed in a surface thereof facing the toner-concentration sensor, so that developer accumulated on such surface during the time when the developing apparatus is in the non-driven condition falls downwardly therefrom.

With such the construction, the developing sleeve is operated e.g. rotated to deliver developer in the appointed direction during the time when the developing apparatus is being driven, so that the excessive developer is guided by the partition plate to pass over the partition plate at a relatively high speed by the rotation of the developing sleeve. Accordingly, even though the partition plate is provided with the holes on the surface thereof facing the toner-concentration sensor, hardly any excessive developer falls downwardly from the partition plate through such holes.

Upon the developing apparatus being brought to the non-driven condition, the operation of the developing sleeve is stopped, so that the excessive developer falls onto the upper surface of the partition plate. However, this developer falls still further downwardly through the hole, so that hardly any excessive developer is accumulated on the surface of the partition plate facing the toner-concentration sensor.

In a second embodiment of the invention, the developer accumulated on the upper surface of the partition plate is caused to fall downwardly therefrom by applying an AC voltage to the partition plate during the time when the developing apparatus is in the non-driven condition.

With this construction, the developing sleeve is operated e.g. rotates to deliver developer in the appointed direction during the time when the developing apparatus is being driven, so that the excessive developer is guided by the partition plate to pass over the partition plate at a relatively high speed by the rotation of the developing sleeve.

Upon the developing apparatus being brought to the non-driven condition, the operation of the developing sleeve is stopped, so that the excessive developer falls onto the upper surface of the partition plate to tend to be stuck thereto. However, the AC voltage is applied to the partition plate, so that such AC voltage leads to vibration of the developer stuck to the upper surface of the partition plate. Thus, such developer is caused to fall downwardly therefrom. Accordingly, hardly any excessive developer is accumulated on the surface of the partition plate facing the toner-concentration sensor.

In a third embodiment of the invention, the developer accumulated on the upper surface of the partition plate is caused to fall downwardly therefrom by swinging or vibrating the partition plate during the time when the developing apparatus is in the non-driven condition.

With this construction, the developing sleeve is operated, e.g. rotated, to transport developer in the appointed direction while the partition plate is stationary during the time when the developing apparatus is being driven, so that the excessive developer is guided by means of the partition plate to pass over the partition plate at a relatively high speed by the rotation of the developing sleeve.

Upon the developing apparatus being brought to the non-driven condition, the operation of the developing sleeve is stopped, so that the excessive developer falls onto the upper surface of the partition plate and tends to be accumulated thereon. However, the developer stuck to the upper surface of the partition plate is caused to fall downwardly therefrom by swinging or vibrating the partition plate. Thus, hardly any excessive developer is accumulated on the surface of the partition plate facing the toner-concentration sensor.

In a fourth embodiment of the invention, the partition plate is adapted to be movable so that a position of the partition plate during the time when the developing apparatus is in the non-driven condition is different from a position of the partition plate during the time when the developing apparatus is being driven.

With this construction, the developing sleeve is operated, e.g. rotated, to deliver developer in the appointed direction while the partition plate is stationary during the time when the developing apparatus is being driven, so that the excessive developer is guided by means of the partition plate to pass over the partition plate at a relatively high speed by the rotation of the developing sleeve.

Upon the developing apparatus being brought to the non-driven condition, the operation of the developing sleeve is stopped, so that the excessive developer falls onto the upper surface of the partition plate and tends to be accumulated thereon. However, a member of the partition plate facing, for example, the toner-concentration sensor is displaced downwardly, so that the developer accumulated on an upper surface of such member falls downwardly therefrom. Accordingly, hardly any excessive developer is accumulated on the surface of the partition plate facing the toner-concentration sensor.

BRIEF DESCRIPTION OF THE DRAWINGS

Preferred embodiments of the invention will be described below with reference to the accompanying drawings, wherein.

DESCRIPTION OF THE PREFERRED EMBODIMENTS

Figure 1:
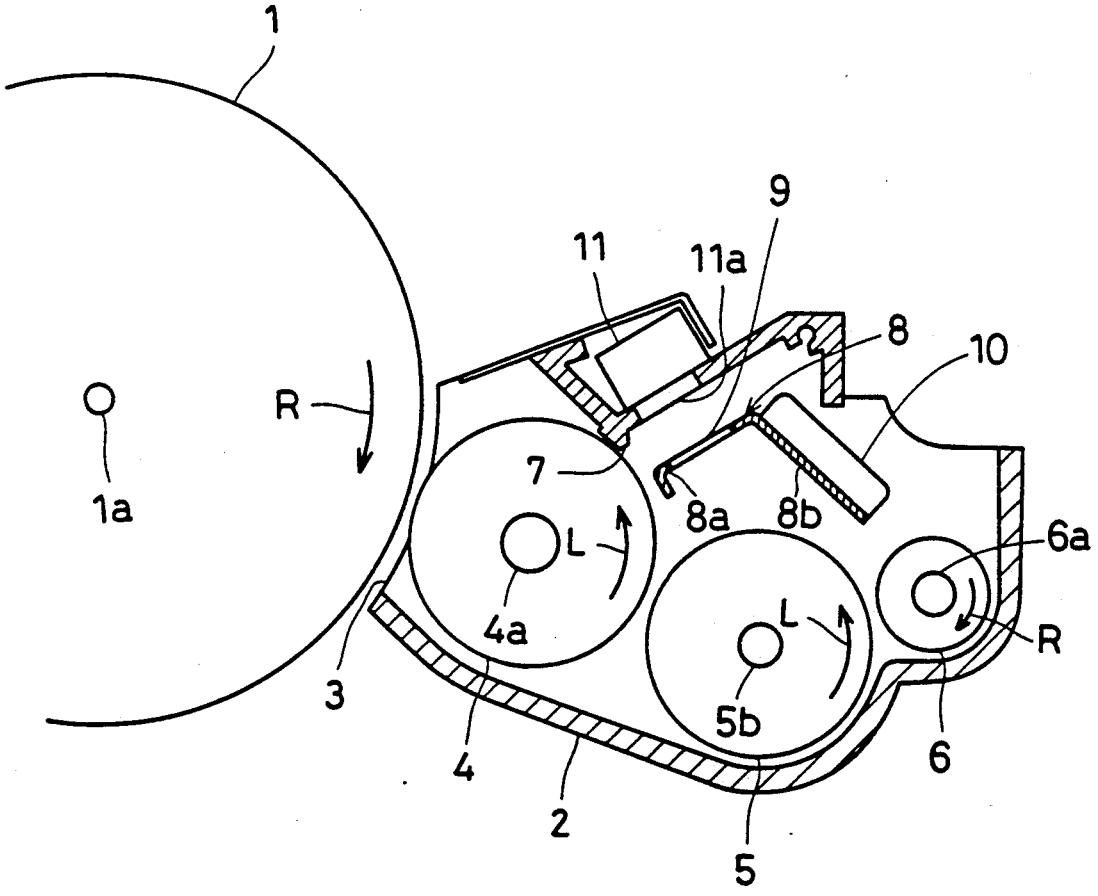
FIG. 1 is a sectional view showing a developing apparatus according to a first embodiment of the invention.
Figure 2:
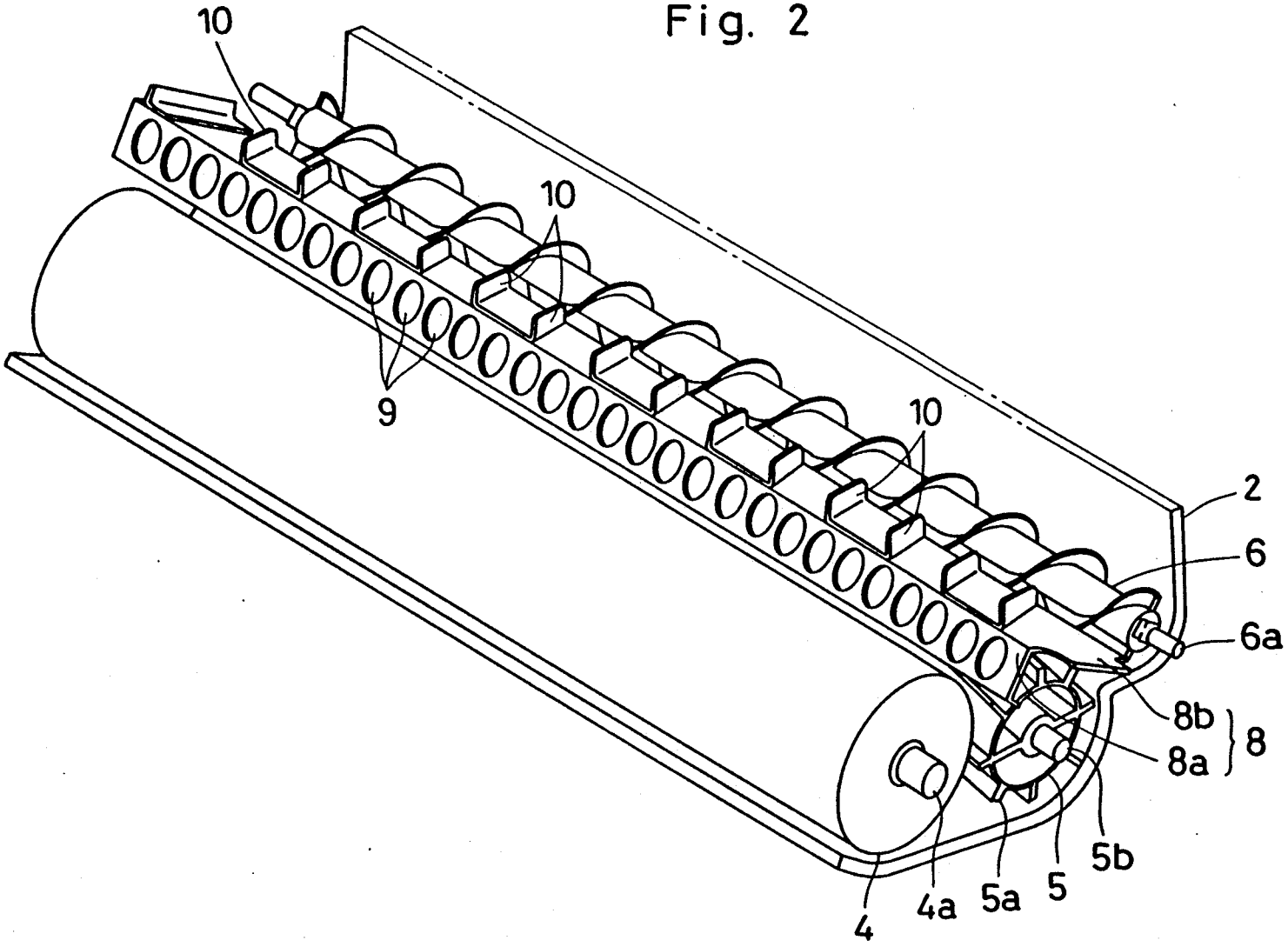
FIG. 2 is a perspective view showing main parts of the developing apparatus shown in FIG. 1.

A first embodiment of the invention is shown in FIGS. 1 to 4. Referring to FIG. 1, reference numeral 1 designates a photoreceptor rotating in the direction of an arrow R with an axis of rotation 1*a* as a center, reference numeral 2 designates a case for housing therein a developer comprising toner particles and carrier particles, and case 2 is provided with an opening portion 3 facing photoreceptor 1.

Case 2 is provided therein with a developing member such as sleeve 4, developer-stirring and supplying means 5, developer-transporting means 6, and the like, that may be rotated in direction noted. A height-regulating member 7 regulates the thickness or height of the relatively excessive developer supplied to sleeve 4 by operation, e.g. rotation, of developing sleeve 4 relative to member 7. A partition plate 8 guides excessive developer, after regulation of the height of the developer on sleeve 4, toward developer-transporting means 6 to return the excessive developer thereto.

The developing sleeve 4 is provided therein with a stationary magnet roller (not shown) and is rotated in the direction of an arrow L with an axis of rotation 4*a* as a center to supply the photoreceptor 1 with the developer. Developer-stirring and supplying means 5 is provided with a plurality of spiral stirring blades 5*a* (FIG. 2) formed on an outer circumferential surface thereof and if rotated in the direction of an arrow L with an axis of rotation 5*b* as a center to stir the developer and supply the developing sleeve 4 with the developer. In addition, the developer-transporting means 6 is formed of, for example, a spiral shaft and is rotated in the direction of an arrow R with an axis of rotation 6*a* as a center to stir the excessive developer, returned after regulation of the height of the developer on sleeve 4 by means of the partition plate 8, and toner particles supplied from a toner supply (not shown), and to transport the resulting mixture in a direction toward the developer-stirring and supplying means 5.

In order to prevent the developer from being accumulated thereon, the partition plate 8 is formed in, for example, a chevron shape and includes an inclined surface 8*a* on the upstream side, with respect to the returning direction of the excess toner, and an inclined surface 8*b* on the downstream side with respect to such returning direction. Inclined surface 8*a* is provided with a plurality of holes 9 formed therein at suitable intervals, and inclined surface 8*b* is provided at suitable intervals therealong with a plurality of biasing guides 10 for biasing the returning excessive developer toward one axial end of the developer-stirring and supplying means 5.

Referring to FIG. 1 again, reference numeral 11 designates a toner-concentration sensor disposed on case 2 in the vicinity of the height-regulating member 7 so that a sensor portion 11*a* faces inclined surface 8*a* of the partition plate 8.

Next, the operation of the developing apparatus having the above described construction will be described with reference to FIG. 3.

Figure 3:
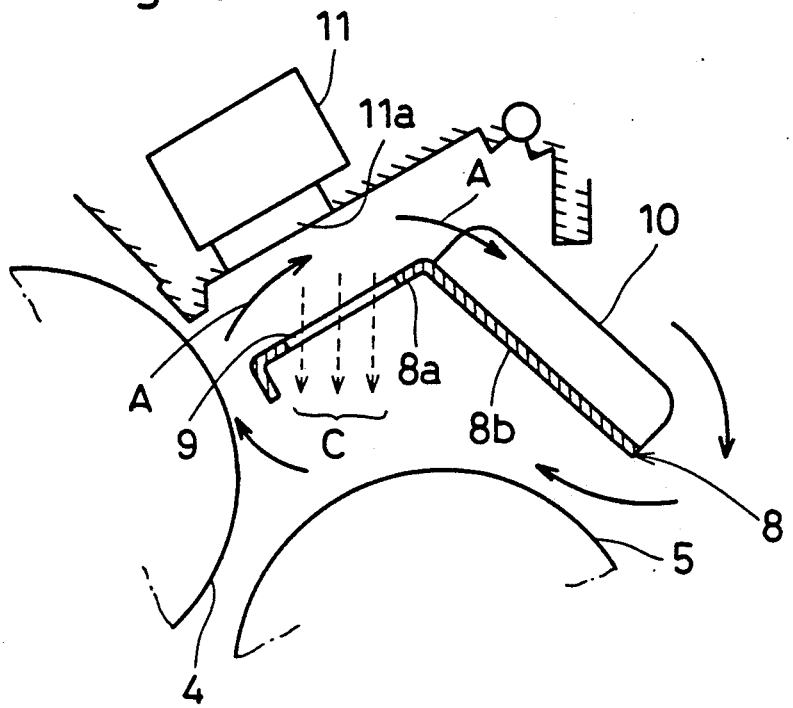
FIG. 3 is a diagram illustrating the operation thereof.

The developing sleeve 4 is operated, e.g. rotated, to transport developer in the appointed direction during a time when the developing apparatus is driven to conduct a copying operation, so that, as shown by arrows A in FIG. 3, the excessive developer separated from sleeve 4 by regulating the height of the developer on sleeve 4 is guided by the partition plate 8 to pass thereover due to the operation of the developing sleeve 4. Accordingly, even though the inclined surface 8*a* on the upstream side in the returning direction facing the toner-concentration sensor 11 is provided with the holes 9 hardly any developer falls through holes 9 to below the partition plate 8. Thus, the change in magnetic permeability of the developer can be detected surely by means of the toner-concentration sensor 11.

Upon the developing apparatus being brought to a non-driven condition after the completion of a copying operation, the operation of the developing sleeve 4 is stopped. Thus, excessive developer passed along surface 8*a* falls onto the upper surface of the partition plate 8, but such developer falls still further downwardly through holes 9, as shown by arrows C in imaginary lines in FIG. 3. Thereby, hardly any excessive developer is accumulated on the inclined surface 8*a*. Accordingly, the excessive developer is prevented from being set on inclined surface 8*a* facing the toner-concentration sensor 11.

Figure 4:
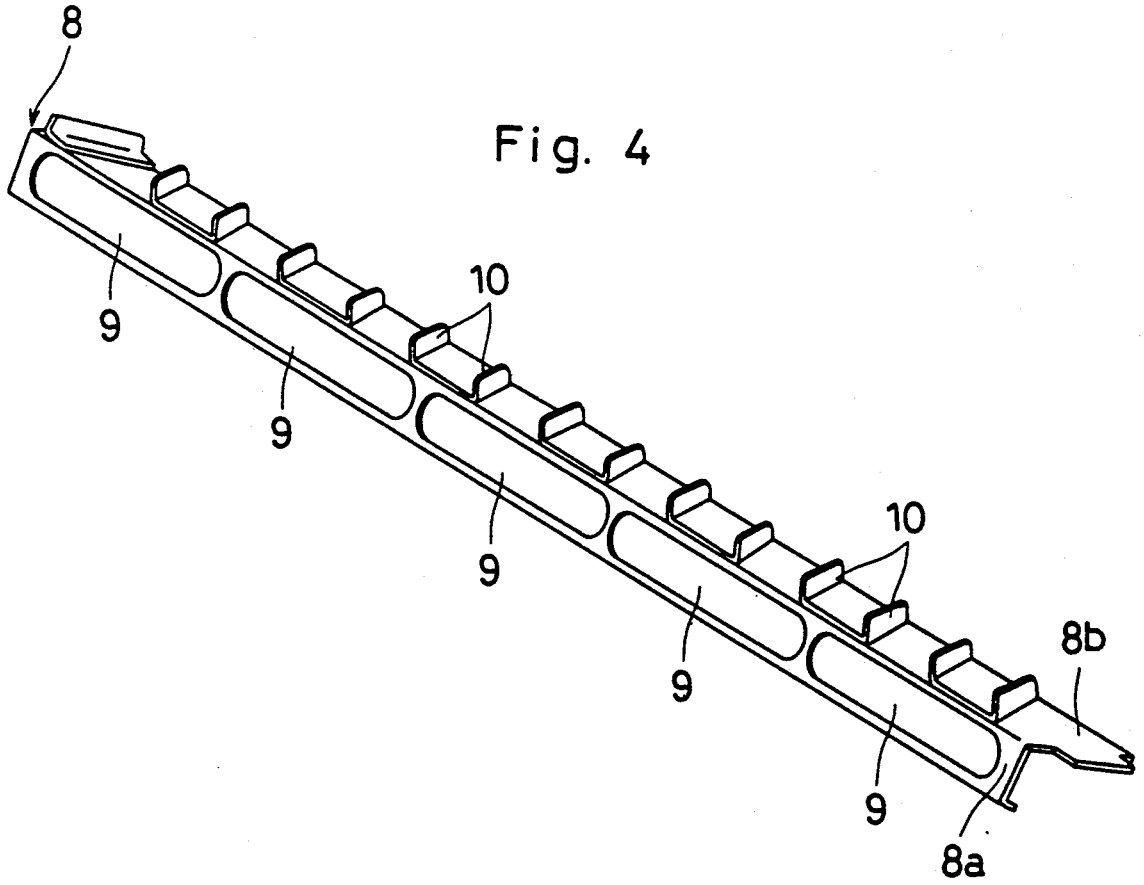
FIG. 4 is a perspective view showing another preferred embodiment of a partition plate.

Also, the holes 9 formed in the partition plate 8 may be elongated, for example as shown in FIG. 4. In addition, with a view to the strength of the partition plate 8 or to the relatively highly efficient return of the developer, the number of holes 9 formed in the partition plate 8 maybe reduced as is necessary. It is sufficient if the number of holes causes the excessive developer to fall downwardly speedily and almost completely.

In addition, although the partition plate 8 is formed in a chevron shape in the above described preferred embodiment, the shape of the partition plate 8 is not limited to such chevron shape, but also a flat plate may be used. In such case, it is sufficient that the partition plate be slightly inclined so that the developer on the partition plate can be introduced into holes 9.

Figure 5:
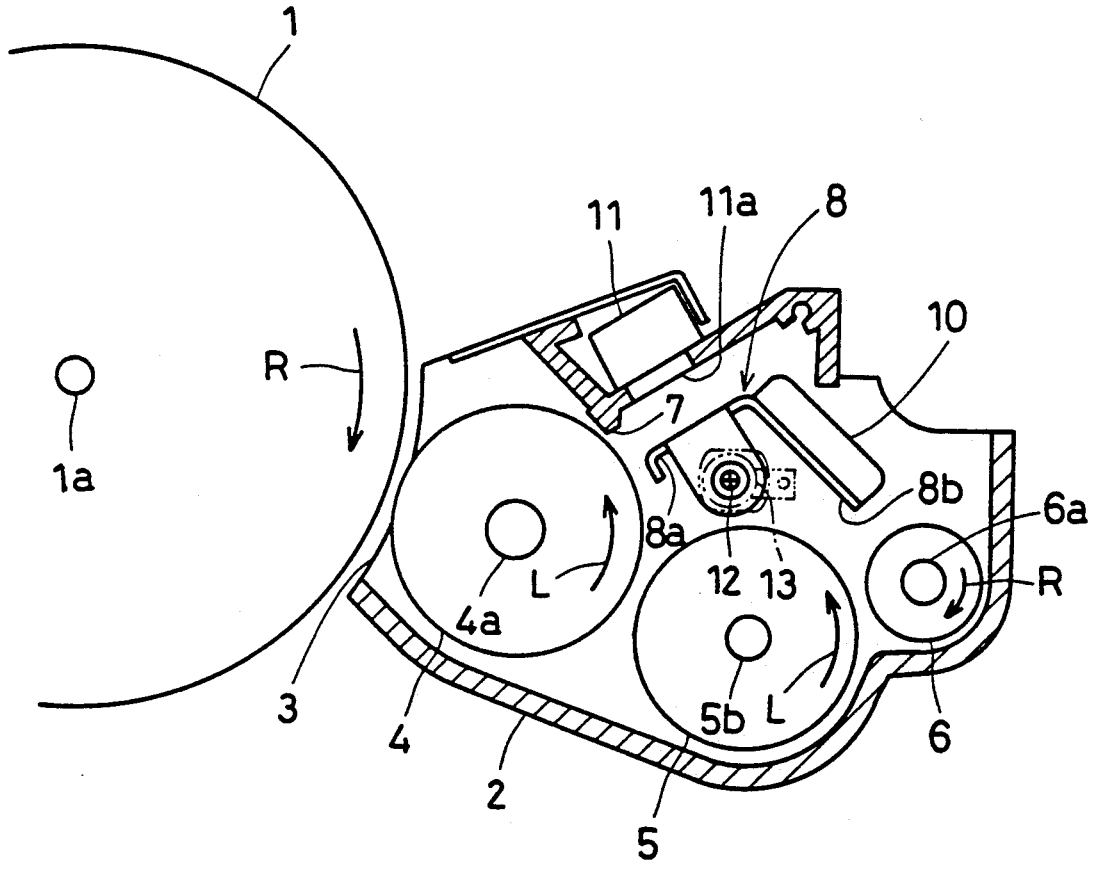
FIG. 5 is a sectional view showing a developing apparatus according to a second embodiment of the invention.
Figure 6:
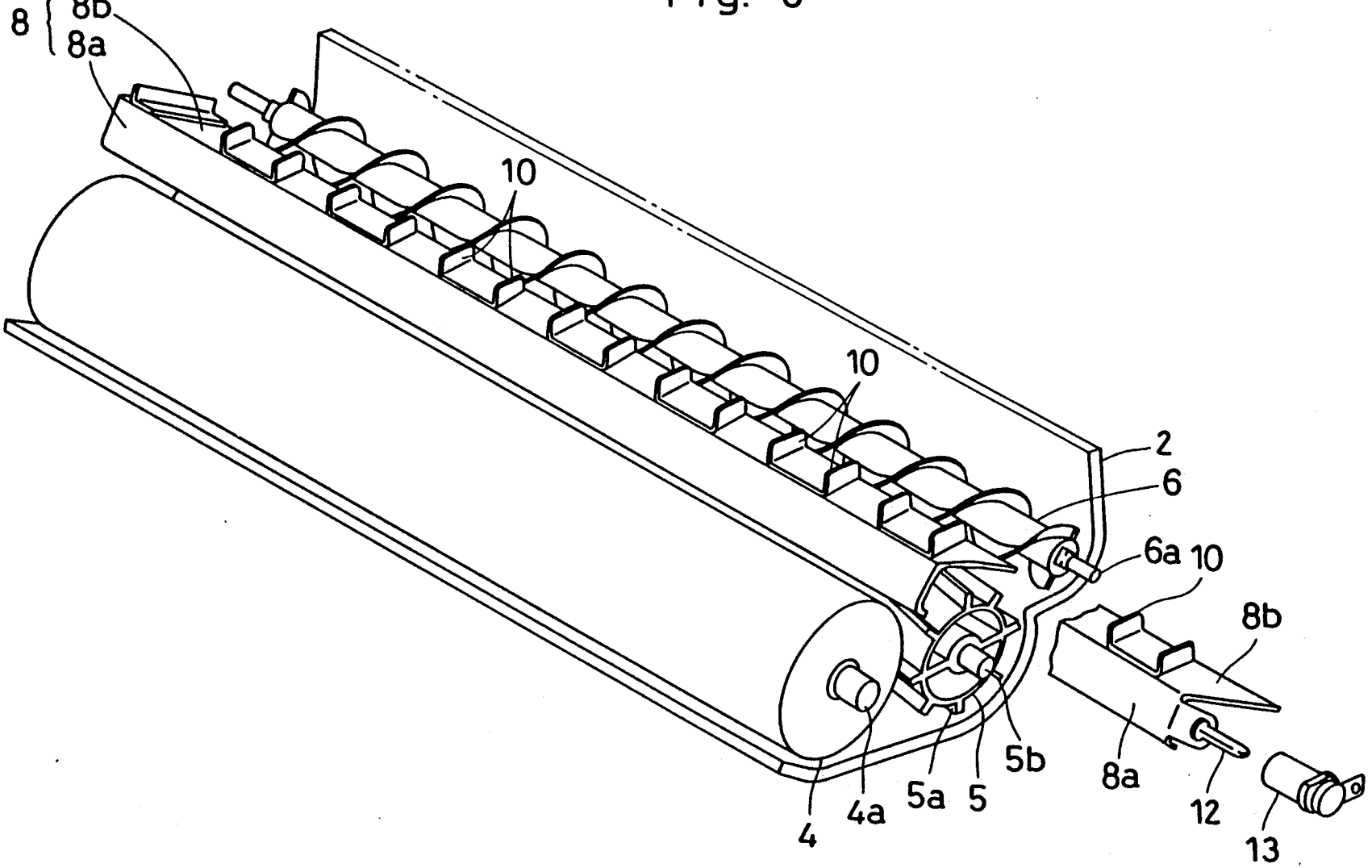
FIG. 6 is a perspective view showing main parts of the developing apparatus shown in FIG. 5.
Figure 7:
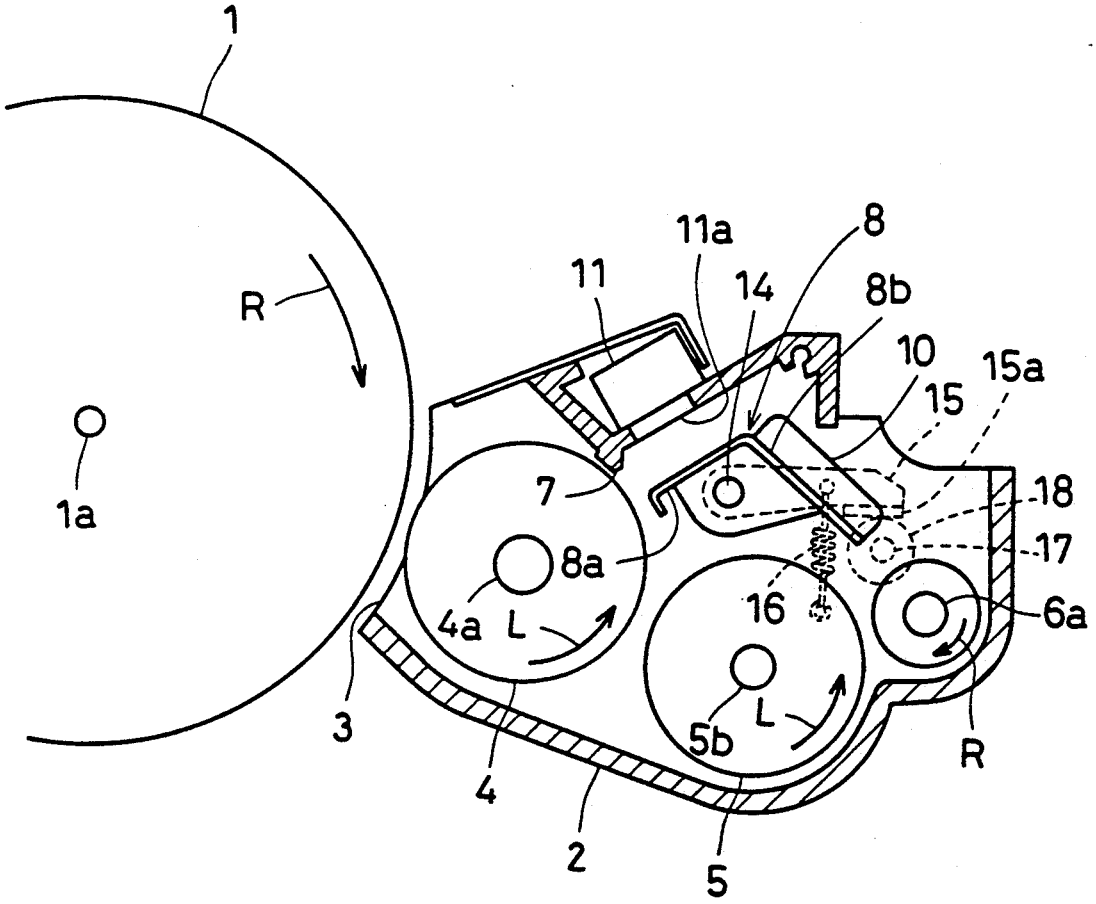
FIG. 7 is a sectional view showing a developing apparatus according to a third embodiment of the invention.
Figure 8:
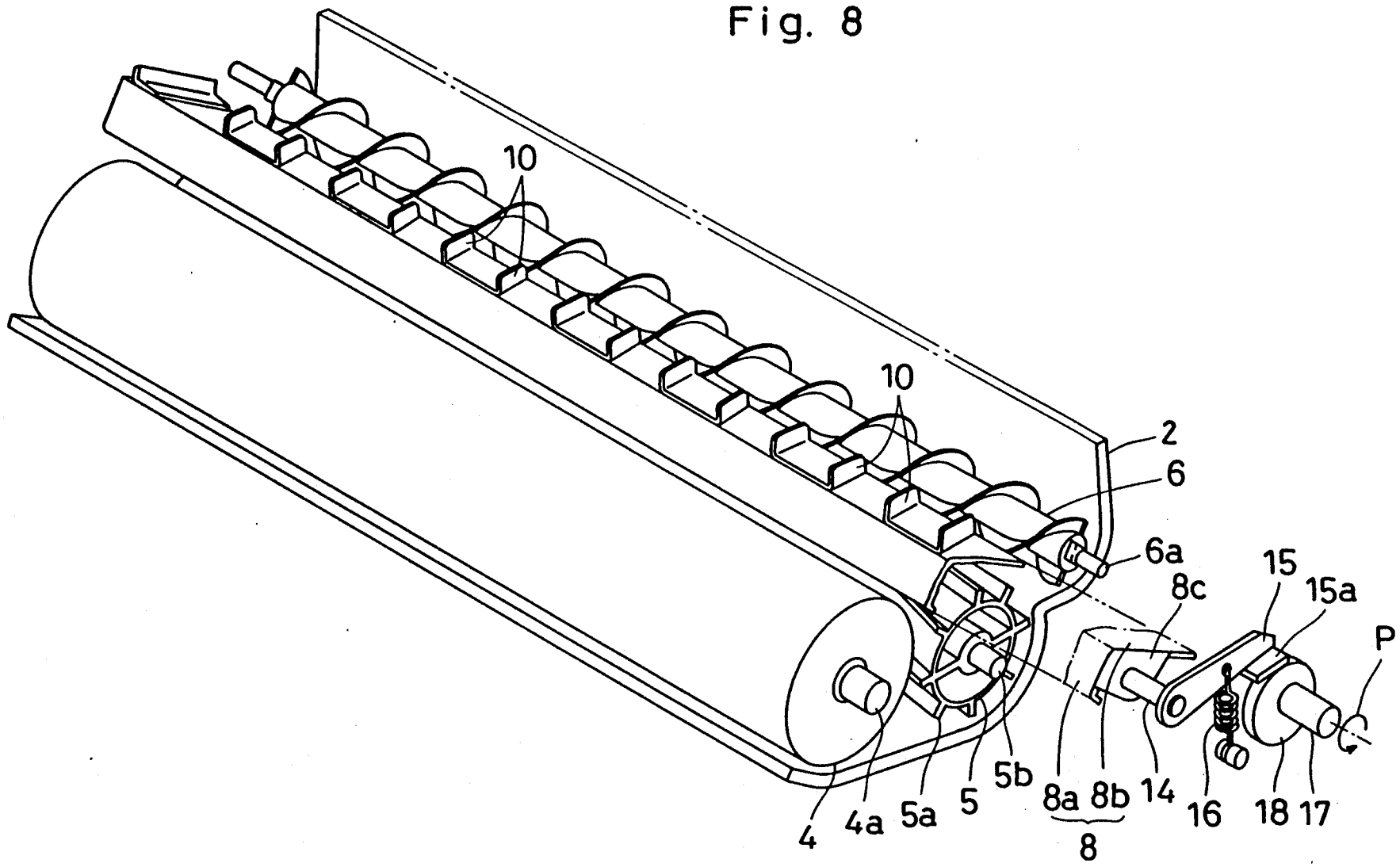
FIG. 8 is a perspective view showing main parts of the developing apparatus shown in FIG. 7.

FIGS. 5 an 6 show a second embodiment of the invention. Referring to FIGS. 5 and 6 the same reference numerals designate the same members as in FIGS. 1 to 4. In this embodiment, AC voltage is applied to the partition plate 8 during the time when the developing apparatus is in the non-driven condition. That is to say, referring to FIGS. 5 and 6, reference numeral 12 designates a contact terminal formed on an end portion of the partition plate 8 so as to project from the case 2, and reference numeral 13 designates a contact plug adapted not only to be connected with an AC power source (not shown) but also to be detachably connected with contact terminal 12, so that upon bringing the developing apparatus to the non-driven condition, the AC voltage can be applied to the partition plate 8.

With this construction, the developing sleeve 4 is operated, e.g., rotated, to deliver developer in the appointed direction during the time when the developing apparatus is driven to conduct a copying operation, so that the excessive developer, removed after regulating the height of the developer on sleeve 4, is caused to pass over the partition plate 8. Accordingly, the change in magnetic permeability of the developer can be surely detected by means of the toner-concentration sensor 11.

Upon bringing the developing apparatus to the non-driven condition after the completion of the copying operation, the operation of the developing sleeve 4 is stopped, so that the excessive developer falls onto the upper surface of the partition plate 8 with a tendency to be stuck thereto. However, the AC voltage is applied to the partition plate 8, so that the developer is caused to vibrate and falls downward from the upper surface of the partition plate 8. Accordingly, hardly any excessive developer is accumulated on the partition plate 8, in particular on the inclined surface 8*a* of the partition plate 8 facing the toner-concentration sensor 11. In addition, in this embodiment of the invention, the partition plate 8 also may be formed in the shape of a flat plate.

FIGS. 7 to 11 show a third embodiment of the invention. Referring to FIGS. 7 to 11, the same reference numerals designate the same members as in FIGS. 1 to 4. In this embodiment, partition plate 8 is adapted to swing or vibrate during the time when the developing apparatus is in the non-driven condition. That is to say, referring to FIGS. 7 and 8, reference numeral 14 designates a shaft mounted on a bracket member 8*c* on one end side of the partition plate 8, and shaft 14 is provided with a lever 15 fixedly mounted thereon. A contact member 15*a* formed at a lower end portion of a free end of lever 15 is adapted to be always brought into contact with a disk cam 18, fixedly mounted on an axis of rotation 17 rotating in the direction shown by, for example, an arrow P by means of a driving source (not shown) only during the time when the developing apparatus is in the non-driven condition, by a spring 16 always urging lever 15 downwardly.

Figure 9:
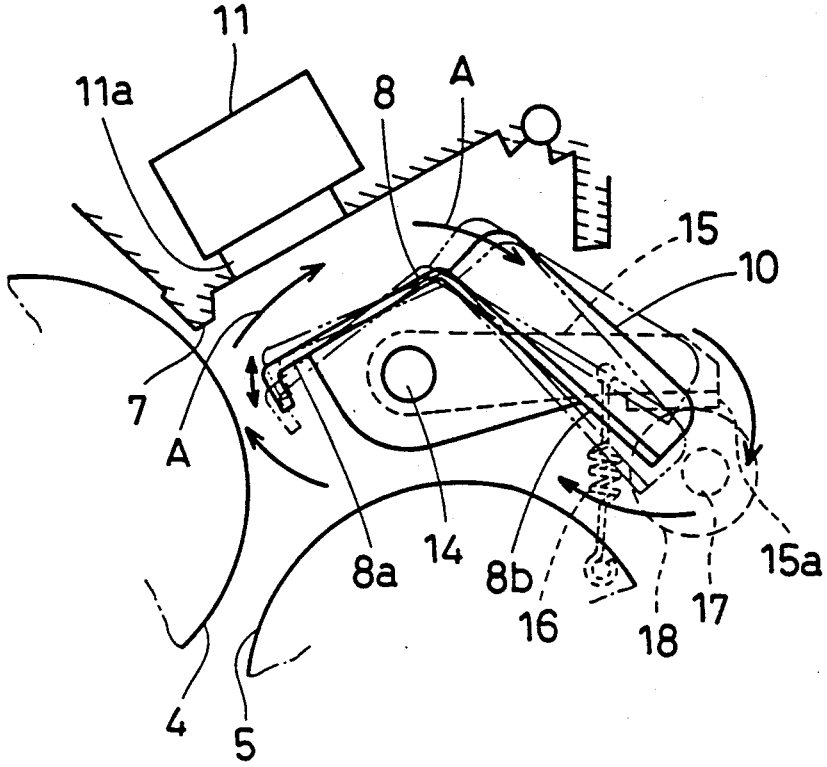
FIG. 9 is a diagram illustrating the operation thereof.

With this construction, the developing sleeve 4 is operated, e.g. rotated, to deliver in the appointed direction while the partition plate 8 is stationary during the time when the developing apparatus is being driven to conduct a copying operation, so that the excessive developer is guided by means of the partition plate 8 to pass over the partition plate 8, as shown by arrows A in FIG. 9. Accordingly, the change in magnetic permeability of the developer can be surely detected by means of the toner-concentration sensor 11.

Upon bringing the developing apparatus to the non-driven condition after the completion of the copying operation, the operated, e.g. rotated, of the developing sleeve 4 is stopped, so that the excessive developer falls onto the upper surface of the partition plate 8 with a tendency to be stuck thereto. However, the axis of rotation 17 is rotated in the direction shown by the arrow P by the driving source (not shown) to move the lever 15 up and down due to eccentric rotation of the disk cam 18 fixedly mounted on axis of rotation 17. Thereby, as shown by imaginary lines in FIG. 9, the partition plate 8 is reciprocated about the shaft 14 as a center, so that the excessive developer stuck to the upper surface of the partition plate 8 falls downwardly therefrom. Thus, hardly any excessive developer is accumulate on the partition plate 8, in particular the inclined surface 8*a* facing the toner-concentration sensor 11. Thereby, the developer can be prevented from being set on inclined surface 8*a*. The time during which the partition plate 8 is reciprocated need not be long. It is sufficient that the excessive developer be caused to substantially completely fall downwardly from surface 8*a*. In addition, if disk cam 18 is provided with suitable steps (not shown) formed on the outer circumferential surface thereof, the partition plate 8 can be vibrated by a substantial extent, and thus the developer stuck to the partition plate 8 effectively can be caused to fall downwardly.

Figure 10:
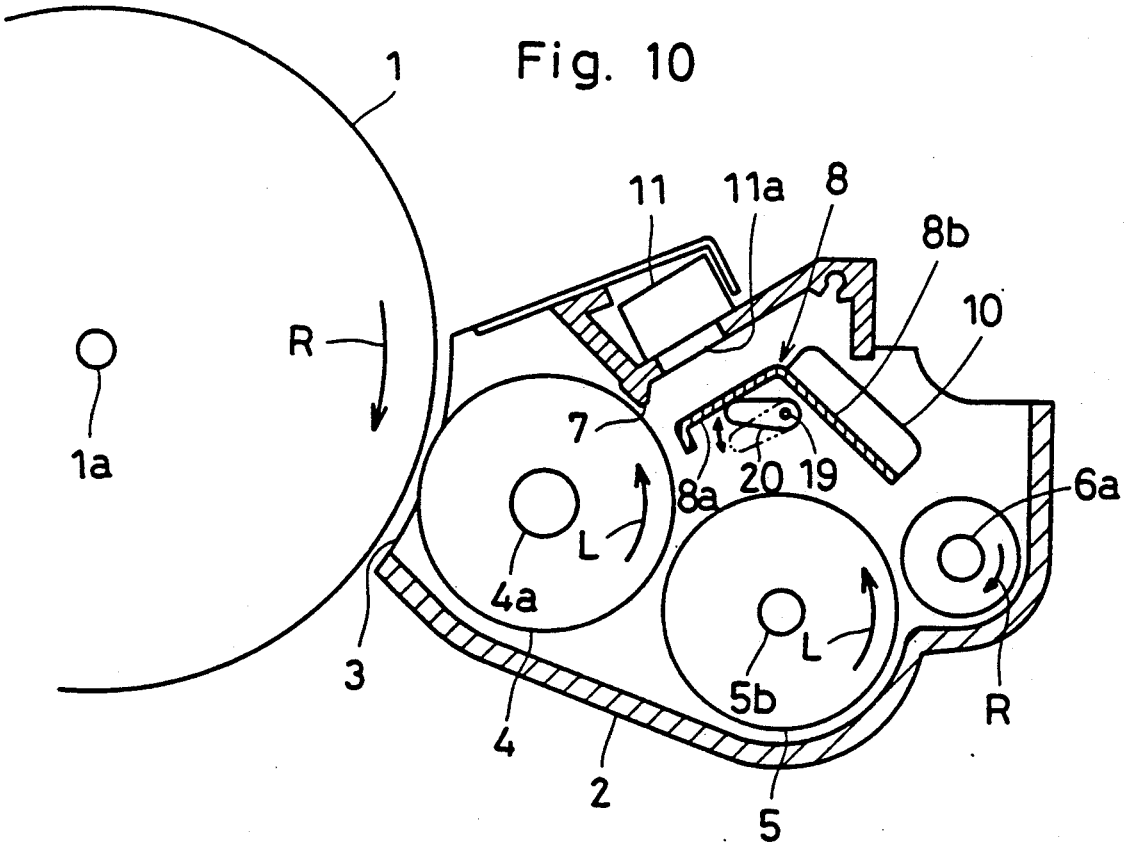
FIG. 10 and FIG. 11 is a sectional view showing main parts of a modification thereof.
Figure 11:
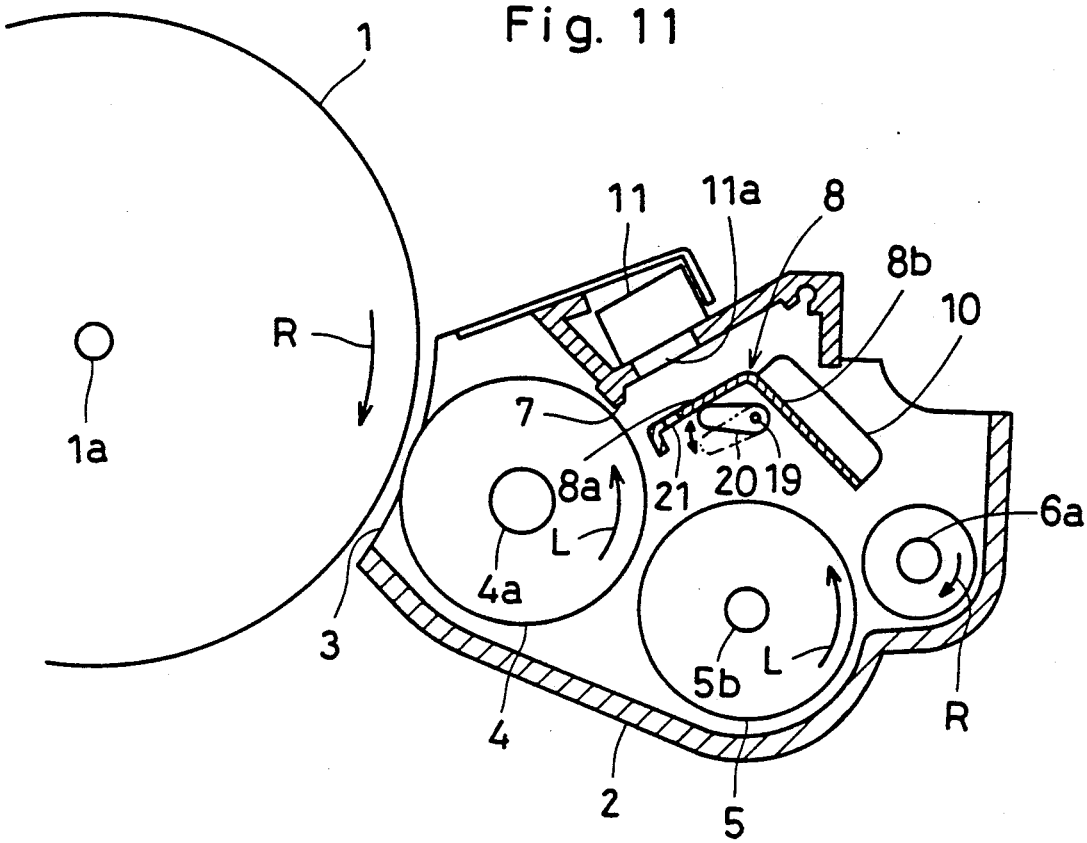

FIG. 10 and FIG. 11 show modification of this embodiment of the invention. Referring to FIG. 10, a lever 20 swinging about a fulcrum 19 as a center is provided below the stationary partition plate 8 to swing lever 20 during the time when the developing apparatus is in the non-driven condition. In addition, referring to FIG. 11, the inclined surface 8*a* facing the toner-concentration sensor 11 is provided with a plurality of holes (slits) 21 to allow the developer to fall more smoothly. In these modifications, the partition plate 8 also may be formed in the shape of a flat plate.

Figure 12:
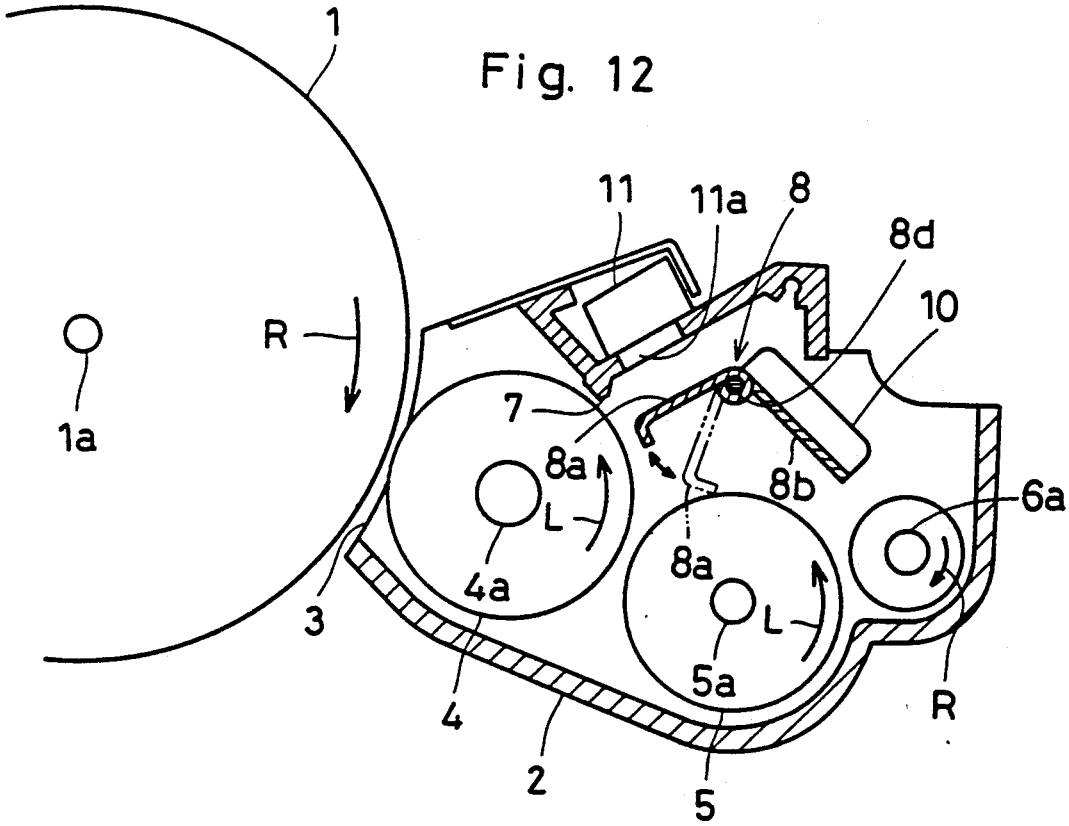
FIG. 12 is a sectional view showing main parts of a developing apparatus according to a fourth embodiment of the invention.

FIG. 12 shows a fourth embodiment of the invention. Referring to FIG. 12, the same reference numerals designate the same members as in FIGS. 1 to 4. In this embodiment, the partition plate is movable so that the position thereof during the time when the developing apparatus is in the non-driven condition is different from that during the time when the developing apparatus is being driven. That is to say, as shown in FIG. 12, the inclined surface 8*a* on the side of partition plate 8 facing the toner-concentration sensor 11 is pivoted relative to the inclined surface 8*b* about a pivot point 8*d* so that the surface 8*a* may be swung between a position facing the toner-concentration sensor 11, as shown by full lines, and a position where it extends downwardly from the pivot point 8*d*, as shown by imaginary lines. Thus, developer stuck to the upper surface will fall downwardly therefrom.

With this construction, the developing sleeve 4 is operated, e.g. rotated to transport developer in the appointed direction to conduct a copying operation during the time when the developing apparatus is being driven while the inclined surface 8*a* of the partition plate 8 is stationary. Thus, the excessive developer is guided by means of inclined surface 8*a* to pass over the inclined surface 8*a*. Accordingly, the change in magnetic permeability of the developer can be surely detected by means of the toner-concentration sensor 11.

Upon bringing the developing apparatus to the non-driven condition after the completion of the copying operation, the operation of the developing sleeve 4 is stopped, so that excessive developer falls onto the upper surface of the inclined surface 8*a* with a tendency to be stuck thereto. However, at this time the inclined surface 8*a* is displaced downwardly by means of a driving source (not shown), so that the developer tending to stick to the upper surface of inclined surface 8*a* falls downwardly therefrom. Accordingly, hardly any excessive developer is accumulated on the partition plate 8, in particular the surface 8*a* facing the toner-concentration sensor 11, and thus the developer can be prevented from being set on inclined surface 8*a*.

In addition, in this embodiment the inclined surface 8*b* also may be adapted to be displaced downwardly in the same manner as the inclined surface 8*a*. Furthermore, in this embodiment the partition plate 8 also may be formed in the shape of a flat plate.

Figure 13:
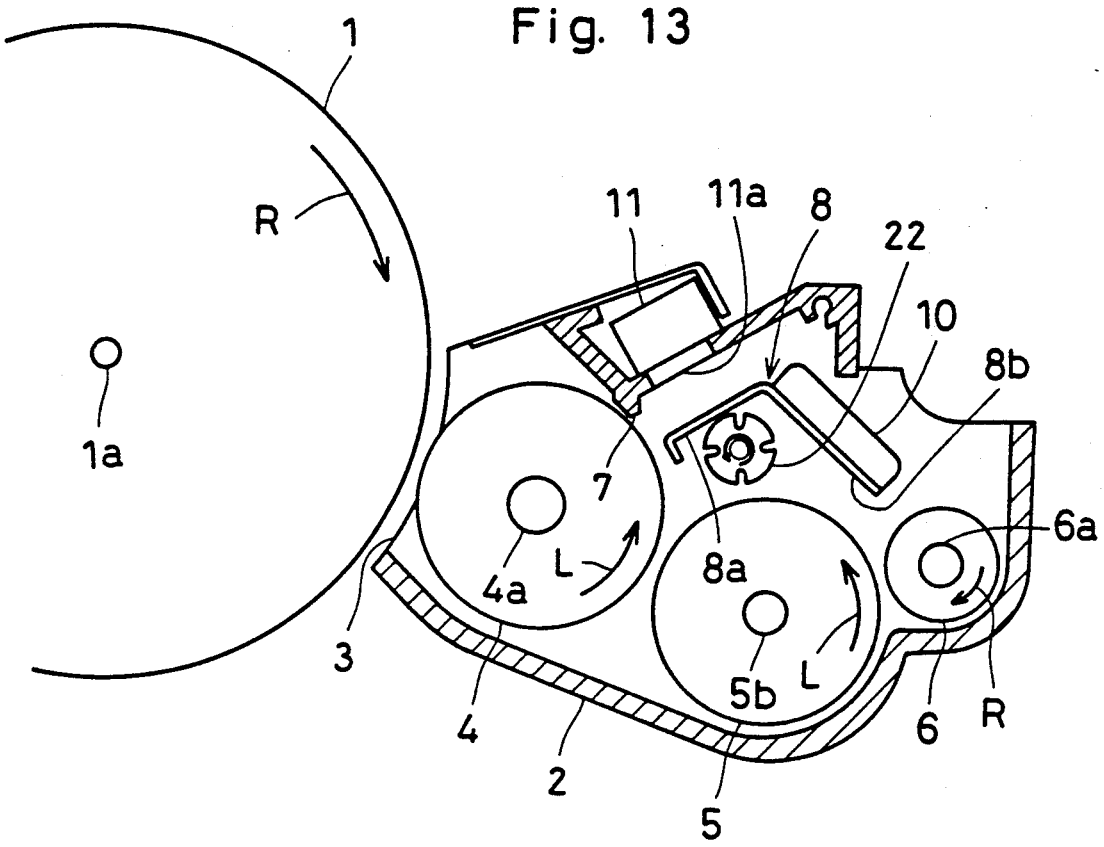
FIG. 13 is a sectional view showing a developing apparatus according to another preferred embodiment.
Figure 14:
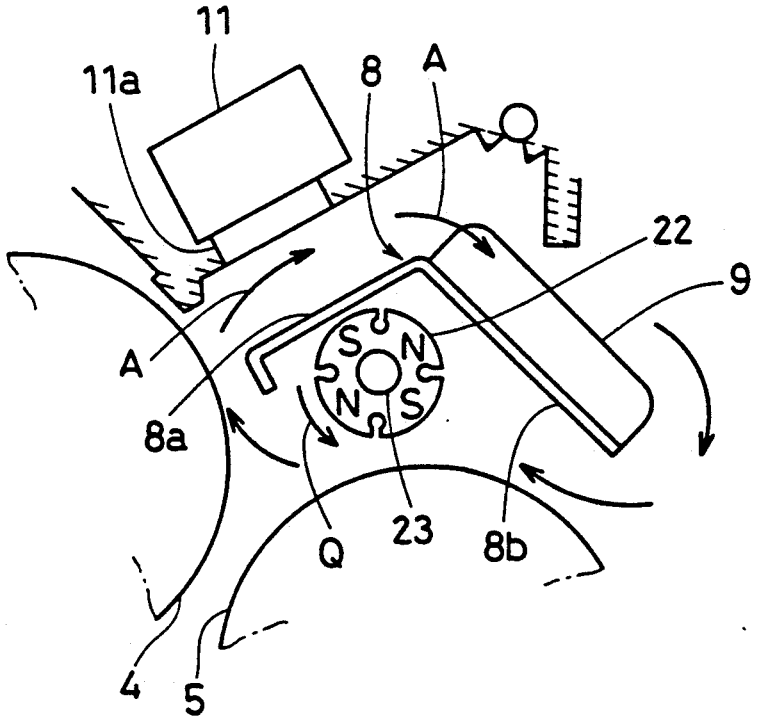
FIG. 14 is a diagram illustrating the operation of the developing apparatus shown in FIG. 13.
Figure 15:
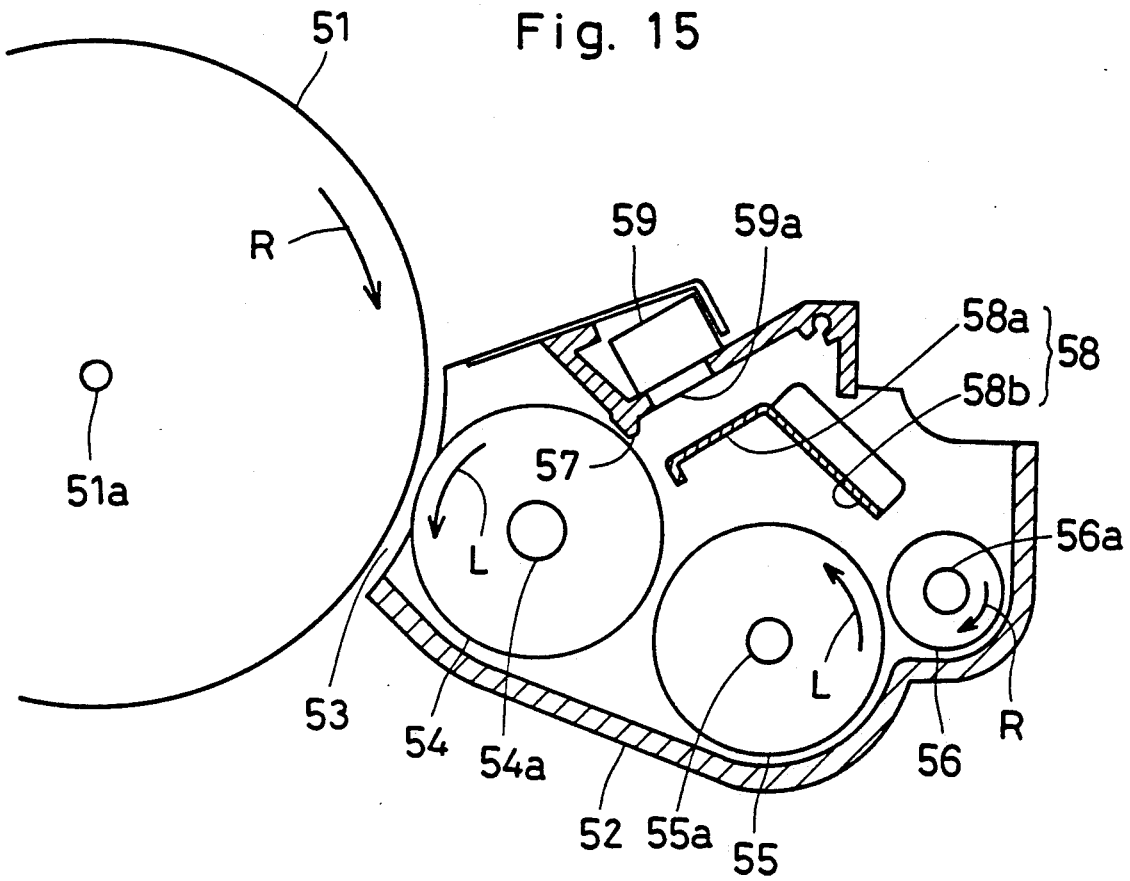
FIG. 15 is a diagram showing a developing apparatus as a comparative example for the present invention.
Figure 16:
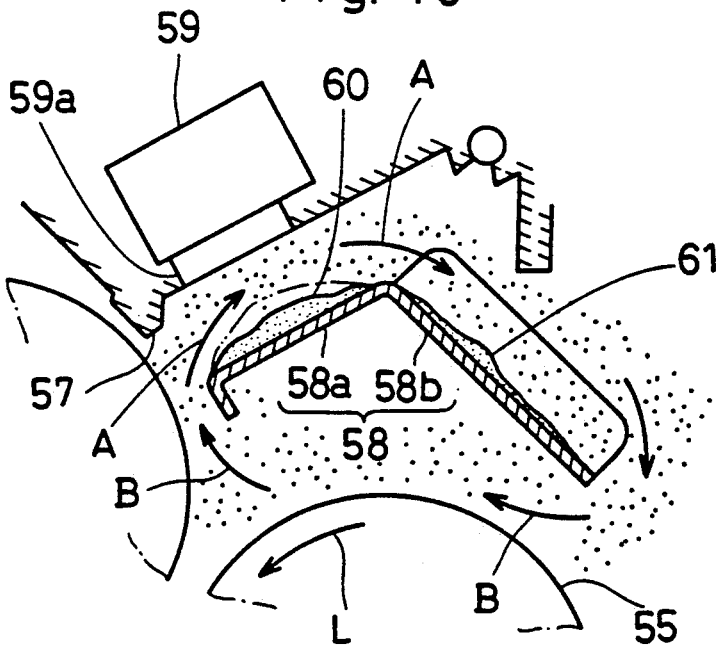
FIG. 16 is a diagram illustrating problems of the developing apparatus shown in FIG. 15.

FIGS. 13 and 14 show a further preferred embodiment. Referring to FIGS. 13 and 14, the same reference numerals designate same members as in FIGS. 1 to 4. Referring to FIG. 13, reference numeral 22 designates a magnet disposed below the partition plate 8 at a slight space or interval from the partition plate 8, i.e. below the inclined surface 8*a*. Magnet 22 is provided with N-poles and S-poles alternately formed on an outer circumferential surface thereof (refer to FIG. 14). A central shaft 23 of the magnet 22 is connected with an output shaft of, for example, a reversible pulse motor (not shown) which is rotated during the time when the developing apparatus is in the non-driven condition, through a gear mechanism (not shown) so as to be rotatable at a suitable rotation frequency.

The developing sleeve 4 is operated, e.g. rotated, to deliver developer in the appointed direction during the time when the developing apparatus is being driven to conduct a copying operation, so that, as shown by arrows A in FIG. 14, the excessive developer is guided by the partition plate 8 to pass over the partition plate 8. Accordingly, the change in magnetic permeability of the developer can be surely detected by means of the toner-concentration sensor Upon bringing the developing apparatus to the non-driven condition, the operation of the developing sleeve 4 is stopped, so that the excessive developer falls onto the upper surface of the partition plate 8. However, the magnet 22 is rotated in the direction shown by the arrow Q by the rotation of the pulse motor in the appointed direction to change the magnetic field below the partition plate 8, whereby developer stuck to the upper surface of the partition plate 8 is attracted downwardly. Thus, the developer falls from the partition plate 8. Accordingly, excessive developer is not accumulated on the upper surface of the partition plate 8, in particular the inclined surface 8*a* facing the toner-concentration sensor. Therefore, the developer can be prevented from being set on inclined surface 8*a* facing the toner-concentration sensor 11.

The time of rotating magnet 22 need not be very long. Such time need by only sufficient such that substantially all the excessive developer stuck to at least the upper surface of the partition plate 8 is caused to completely fall downwardly therefrom. Also in this preferred embodiment, the partition plate 8 may be formed in the shape of a flat plate.

As above described, according to the present invention, not only the detection of the toner concentration during the time when the developing apparatus is being driven is not adversely influenced, but also the excessive developer after regulating the height of the developer on the developing sleeve can be caused to speedily and almost completely fall downwardly during the time when the developing apparatus is in a non-driven condition. Thus, the developer can be prevented from being set on the partition plate and thereby the toner concentration can be always surely detected.

In particular, according to the first embodiment of the invention, it is necessary only to provide the partition plate with holes, and thus this embodiment can be very easily and inexpensively achieved.

We claim:

1. A developing apparatus for use in developing an image on a photoreceptor of an image forming device, said apparatus comprising:

a developing member adapted to have supplied to the periphery thereof a developer including toner particles and carrier particles, said developing member being operable to transport developer in a supply direction to the photoreceptor during a driven time period when an image forming operation is to be performed, and said developing member being inoperable during a non-driven time period when an image forming operation is not being performed;

a height-regulating member, positioned adjacent said periphery of said developing member, for restricting the height of developer on said periphery of said developing member and transported thereby to the photoreceptor, and for deflecting excess developer from said periphery of said developing member in a return direction extending at an angle to the direction of movement of that developer remaining on said periphery of said developing member past said height-regulating member;

a partition plate, positioned adjacent said height-regulating member at a location to be further spaced from the photoreceptor than said height-regulating member, for guiding movement of the excess developer in said return direction;

whereby during the driven time period excess developer is moved due to operation of said developing member in said return direction and guided by said partition plate;

toner-concentration sensor means positioned for sensing the concentration of toner in the excess developer moving over and guided by said partition plate during the driven time period;

whereby during the non-driven time period the excess developer tends to fall onto a surface of said partition plate facing said sensor means due to lack of operation of said developing member; and means for preventing the excess developer from accumulating on said surface of said partition plate during the non-driven time period, said preventing means comprising holes formed through said partition plate in the area of said surface such that excess developer tending to fall onto said surface during the non-driven time period will fall downwardly through said holes.

2. An apparatus as claimed in claim 1, wherein said holes are circular in shape.

3. An apparatus as claimed in claim 1, wherein said holes are elliptical in shape.

4. An apparatus as claimed in claim 1, further comprising developer-stirring and supply means for supplying developer to said periphery of said developing member.

5. An apparatus as claimed in claim 4, wherein said developer-stirring and supply means is.located at a position laterally adjacent said developing member and below said partition plate.

6. A developing apparatus for use in developing an image on a photoreceptor of an image forming device, said apparatus comprising:

a developing member adapted to have supplied to the periphery thereof a developer including toner particles and carrier particles, said developing member being operable to transport developer in a supply direction to the photoreceptor during a driven time period when an image forming operation is to be performed, and said developing member being inoperable during a non-driven time period when an image forming operation is not being performed;

a height-regulating member, positioned adjacent said periphery of said developing member, for restricting the height of developer on said periphery of said developing member and transported thereby to the photoreceptor, and for deflecting excess developer from said periphery of said developing member in a return direction extending at an angle to the direction of movement of that developer remaining on said periphery of said developing member past said height-regulating member;

a partition plate, positioned adjacent said height-regulating member at a location to be further spaced from the photoreceptor than said height-regulating member, for guiding movement of the excess developer in said return direction;

whereby during the driven time period excess developer is moved due to operation of said developing member in said return direction and guided by said partition plate;

toner-concentration sensor means positioned for sensing the concentration of toner in the excess developer moving over and guided by said partition plate during the driven time period;

whereby during the non-driven time period the excess developer tends to fall onto a surface of said partition plate facing said sensor means due to lack of operation of said developing member; and means for preventing the excess developer from accumulating on said surface of said partition plate during said non-driven time period, said preventing means comprising means for applying an AC voltage to said partition plate and thereby for causing excess developer that falls onto said surface during the non-driven time period to vibrate and thereby to fall downwardly from said surface.

7. A developing apparatus for use in developing an image on a photoreceptor of an image forming device, said apparatus comprising:

a developing member adapted to have supplied to the periphery thereof a developer including toner particles and carrier particles, said developing member being operable in a supply direction for transporting developer to the photoreceptor during a driven time period when an image forming operation is to be performed, and said developing member being inoperable during a non-driven time period when an image forming operation is not being performed;

a height-regulating member, positioned adjacent said periphery of said developing member, for restricting the height of developer on said periphery of said developing member and transported thereby to the photoreceptor, and for deflecting excess developer from said periphery of said developing member in a return direction extending at an angle to the direction of movement of that developer remaining on said periphery of said developing member past said height-regulating member;

a partition plate, positioned adjacent said height-regulating member at a location to be further spaced from the photoreceptor than said height-regulating member, for guiding movement of the excess developer in said return direction;

whereby during the driven time period excess developer is moved due to operation of said developing member in said return direction and guided by said partition plate;

toner-concentration sensor means positioned for sensing the concentration of toner in the excess developer moving over and guided by said partition plate during the driven time period;

whereby during the non-driven time period the excess developer tends to fall onto a surface of said partition plate facing said sensor means due to lack of operation of said developing member; and means for preventing the excess developer from accumulating on said surface of said partition plate during the non-driven time period, said preventing means comprising means for reciprocating said partition plate such that excess developer falling onto said surface during the non-driven time period thereby will be caused to fall downwardly from said surface.

8. An apparatus as claimed in claim 7, wherein said reciprocating means operated to swing said partition plate upwardly and downwardly.

9. An apparatus as claim in claim 7, wherein said reciprocating means operates to vibrate said partition plate upwardly and downwardly.

10. An apparatus as claimed in claim 7, wherein said reciprocating means comprises a cam and lever assembly.

11. An apparatus as claimed in claim 7, further comprising holes formed through said partition plate in the area of said surface.

12. An apparatus as claimed in claim 11, wherein said holes are slit-shaped.

13. A developing apparatus for use in developing an image on a photoreceptor of an image forming device, said apparatus comprising:

a developing member adapted to have supplied to the periphery thereof a developer including toner particles and carrier particles, said developing member being operable in a supply direction for transporting developer to the photoreceptor during a driven time period when an image forming operation is to be performed, and said developing member being inoperable during a non-driven time period when an image forming operation is not being performed;

a height-regulating member, positioned adjacent said periphery of said developing member, for restricting the height of developer on said periphery of said developing member and transported thereby to the photoreceptor, and for deflecting excess developer from said periphery of said developing member in a return direction extending at an angle to the direction of movement of that developer remaining on said periphery of said developing member past said height-regulating member;

a partition plate, positioned adjacent said height-regulating member at a location to be further spaced from the photoreceptor than said height-regulating member, for guiding movement of the excess developer in said return direction;

whereby during the driven time period excess developer is moved due to operation of said developing member in said return direction and guided by said partition plate;

toner-concentration sensor means positioned for sensing the concentration of toner in the excess developer moving over and guided by said partition plate during the driven time period;

whereby during the non-driven time period the excess developer tends to fall onto a surface of said partition plate facing said sensor means due to lack of operation of said developing member; and means for preventing the excess developer from accumulating on said surface of said partition plate during said non-driven time period, said preventing means comprising means for moving at least that portion of said partition plate including said surface, such that the position of said portion during said non-driven time period is different than the position of said portion during said driven time period and is such that excess toner will fall downwardly during said non-driven time period.

14. An apparatus as claimed in claim 13, wherein said portion of said partition plate is mounted for pivotal movement about an axis.

* * * * *